US008888577B2

(12) United States Patent
Wolf et al.

(10) Patent No.: US 8,888,577 B2
(45) Date of Patent: Nov. 18, 2014

(54) GAMING SYSTEM AND METHOD FOR PROVIDING OPTIMAL POKER AUTO-HOLD FUNCTIONALITY WITH PROGRESSIVE AWARDS

(71) Applicant: IGT, Reno, NV (US)

(72) Inventors: Bryan D. Wolf, Reno, NV (US); Christopher T. Brune, Carson City, NV (US)

(73) Assignee: IGT, Las Vegas, NV (US)

( * ) Notice: Subject to any disclaimer, the term of this patent is extended or adjusted under 35 U.S.C. 154(b) by 5 days.

(21) Appl. No.: 13/751,949

(22) Filed: Jan. 28, 2013

(65) Prior Publication Data

US 2014/0213336 A1 Jul. 31, 2014

(51) Int. Cl.
*A63F 9/24* (2006.01)
*G07F 17/32* (2006.01)

(52) U.S. Cl.
CPC ..... *G07F 17/3262* (2013.01); *G07F 17/323* (2013.01); *G07F 17/3288* (2013.01)
USPC ..... 463/13; 463/11; 463/16; 463/22

(58) Field of Classification Search
USPC ..... 463/13–16
See application file for complete search history.

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,711,451 | A | 12/1987 | Pajak et al. |
| 5,033,744 | A | 7/1991 | Bridgeman et al. |
| 5,085,436 | A | 2/1992 | Bennett |
| 5,100,137 | A | 3/1992 | Fulton et al. |
| 5,102,137 | A | 4/1992 | Ekiert |
| 5,108,099 | A | 4/1992 | Smyth |
| 5,167,413 | A | 12/1992 | Fulton et al. |
| 5,251,897 | A | 10/1993 | Fulton et al. |
| 5,280,909 | A | 1/1994 | Tracy et al. |
| 5,322,295 | A | 6/1994 | Cabot et al. |
| 5,344,144 | A | 9/1994 | Canon et al. |
| 5,364,104 | A | 11/1994 | Jones et al. |
| 5,374,067 | A | 12/1994 | Jones et al. |
| 5,377,973 | A | 1/1995 | Jones et al. |
| 5,380,012 | A | 1/1995 | Jones et al. |

(Continued)

FOREIGN PATENT DOCUMENTS

| | | |
|---|---|---|
| GB | 2 062 922 | 5/1981 |
| GB | 2 112 984 | 7/1983 |
| GB | 2 117 155 | 10/1983 |
| GB | 2 165 385 | 4/1986 |

*Primary Examiner* — Tramar Harper
(74) *Attorney, Agent, or Firm* — Neal, Gerber & Eisenberg LLP

(57) ABSTRACT

The present disclosure relates to a gaming system and method providing a draw poker game with auto-hold functionality that takes multiple progressive awards into account and recommends the optimal cards to hold from an initial hand. The draw poker game includes different winning outcomes, different awards associated with the different winning outcomes, and includes a first progressive award associated with a first one of the outcomes and a second progressive award associated with a second one of the outcomes. For each play of the draw poker game, the gaming system displays a first auto-hold recommendation if the first progressive award is greater than the second progressive award, and the gaming system displays a second different auto-hold recommendation if the second progressive award is greater than the first progressive award.

20 Claims, 10 Drawing Sheets

(56) References Cited

U.S. PATENT DOCUMENTS 5,382,025 A 1/1995 Sklansky et al.
5,401,023 A 3/1995 Wood
5,411,257 A 5/1995 Fulton et al.
5,411,271 A 5/1995 Mirando
5,431,408 A 7/1995 Adams et al.
5,437,451 A 8/1995 Fulton et al.
5,511,781 A 4/1996 Wood et al.
5,511,784 A 4/1996 Furry et al.
5,531,448 A 7/1996 Moody et al.
5,636,842 A 6/1997 Cabot et al.
5,704,835 A 1/1998 Dietz
5,732,950 A 3/1998 Moody et al.
5,755,621 A 5/1998 Marks et al.
5,766,076 A 6/1998 Pease et al.
5,779,545 A 7/1998 Berg et al.
5,803,809 A 9/1998 Yoseloff
5,820,460 A 10/1998 Fulton et al.
5,823,873 A 10/1998 Moody et al.
5,833,536 A 11/1998 Davids et al.
5,855,515 A 1/1999 Pease et al.
5,871,400 A 2/1999 Yfantis et al.
5,873,781 A 2/1999 Keane et al.
5,882,259 A 3/1999 Holmes et al.
5,885,158 A 3/1999 Torango et al.
5,911,418 A 6/1999 Adams et al.
5,954,335 A 9/1999 Moody et al.
5,957,774 A 9/1999 Holmes et al.
5,967,893 A 10/1999 Lawrence et al.
5,967,894 A 10/1999 Kinoshita et al.
6,007,066 A 12/1999 Moody et al.
6,024,642 A 2/2000 Stupak
6,050,658 A 4/2000 O'Sullivan et al.
6,062,979 A 5/2000 Inoue
6,062,981 A 5/2000 Luciano
6,098,985 A 8/2000 Moody et al.
6,110,043 A 8/2000 Olsen
6,117,009 A 9/2000 Yoseloff
6,135,883 A 10/2000 Hachquet
6,146,273 A 11/2000 Olsen et al.
6,159,096 A 12/2000 Yoseloff
6,176,781 B1 1/2001 Walker et al.
6,193,235 B1 2/2001 Vancura et al.
6,193,607 B1 2/2001 Kay
6,196,547 B1 3/2001 Pascal et al.
6,203,010 B1 3/2001 Jorasch et al.
6,210,275 B1 4/2001 Olsen
6,248,016 B1 6/2001 Walker et al.
6,257,979 B1 7/2001 Walker et al.
6,275,586 B1 8/2001 Kelly
6,290,601 B1 9/2001 Yamazaki et al.
6,311,978 B1 11/2001 Moody
6,332,839 B2 12/2001 Walker et al.
6,334,613 B1 1/2002 Yoseloff
6,343,989 B1 2/2002 Wood et al.
6,347,795 B1 2/2002 De Leljer
6,406,023 B1 6/2002 Rowe
6,419,578 B1 7/2002 Moody et al.
6,422,940 B1 7/2002 Walker et al.
6,435,511 B1 8/2002 Vancura et al.
6,474,645 B2 11/2002 Tarantino
6,477,251 B1 11/2002 Szrek et al.
6,485,367 B1 * 11/2002 Joshi ..... 463/13
6,517,074 B1 2/2003 Moody et al.
6,523,829 B1 2/2003 Walker et al.
6,533,658 B1 3/2003 Walker et al.
6,537,150 B1 3/2003 Luciano et al.
6,561,898 B2 5/2003 Moody
6,568,680 B1 5/2003 Moody et al.
6,569,014 B2 5/2003 Walker et al.
6,592,456 B2 7/2003 Walker et al.
6,599,193 B2 7/2003 Baerlocher et al.
6,652,377 B1 11/2003 Moody
6,672,959 B2 1/2004 Moody et al.
6,726,427 B2 4/2004 Jarvis et al.
6,729,961 B1 5/2004 Millerschone
6,884,168 B2 4/2005 Wood et al.
6,916,245 B1 7/2005 Vancura et al.
6,923,719 B2 8/2005 Wolf
6,935,950 B2 8/2005 Tarantino
6,955,356 B2 10/2005 Moody
6,964,418 B2 11/2005 Moody
6,969,316 B2 11/2005 Jarvis et al.
6,991,538 B2 1/2006 Cannon
6,994,624 B2 2/2006 Gold et al.
7,056,207 B2 6/2006 Walker et al.
7,059,965 B2 6/2006 Jackson
7,070,505 B2 7/2006 Vancura et al.
7,137,628 B2 11/2006 Moody
7,156,397 B2 1/2007 Moody et al.
7,156,734 B1 1/2007 Walker et al.
7,198,569 B2 4/2007 Wolf et al.
7,201,655 B2 4/2007 Walker et al.
7,217,187 B2 * 5/2007 Vancura ..... 463/9
7,222,857 B2 5/2007 Moody
7,222,858 B2 5/2007 Moody
7,247,092 B2 7/2007 Jarvis
7,297,057 B2 11/2007 Gerrard et al.
7,297,059 B2 11/2007 Vancura et al.
7,354,344 B2 4/2008 Paulsen et al.
7,357,716 B2 4/2008 Marks et al.
7,387,568 B2 6/2008 Millerschone
7,390,258 B2 6/2008 Millerschone
7,393,276 B2 7/2008 Millerschone
7,404,762 B2 7/2008 Moody
7,416,186 B2 8/2008 Walker et al.
7,419,162 B2 9/2008 Lancaster et al.
7,431,644 B2 10/2008 Moody
7,470,184 B2 12/2008 Baerlocher et al.
7,476,542 B2 1/2009 Walker et al.
7,488,251 B2 2/2009 Kaminkow
7,524,243 B2 4/2009 Bansemer et al.
7,568,973 B2 8/2009 Iddings et al.
7,585,223 B2 9/2009 Iddings et al.
7,597,621 B2 10/2009 Baerlocher
7,601,060 B2 10/2009 Baerlocher et al.
7,614,946 B2 11/2009 Nicely
7,641,197 B2 1/2010 Jackson
7,651,392 B2 1/2010 Pennington et al.
7,658,672 B1 2/2010 Wolf et al.
7,666,093 B2 2/2010 Lafky et al.
7,666,094 B2 2/2010 Baerlocher et al.
7,674,178 B2 3/2010 Baerlocher et al.
7,674,179 B2 3/2010 Baerlocher et al.
7,677,971 B2 3/2010 Baerlocher et al.
7,677,972 B2 3/2010 Baerlocher et al.
7,682,248 B2 3/2010 Baerlocher et al.
7,713,120 B2 5/2010 Cannon
7,748,714 B2 7/2010 Nicely et al.
7,749,059 B2 7/2010 Tarantino
7,749,061 B2 7/2010 Walker et al.
7,753,784 B2 7/2010 Baerlocher
7,771,274 B2 8/2010 Walker et al.
7,780,520 B2 8/2010 Baerlocher
7,780,523 B2 8/2010 Baerlocher et al.
7,785,188 B2 8/2010 Cannon
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,841,939 B2 11/2010 Baerlocher et al.
7,857,693 B1 12/2010 Johnson et al.
7,862,417 B2 1/2011 Nicely
7,867,073 B2 1/2011 Walker et al.
7,905,778 B2 3/2011 Breckner et al.
7,914,369 B2 3/2011 Walker et al.
7,914,377 B2 3/2011 Benbrahim et al.
7,918,724 B2 4/2011 Walker et al.
7,922,571 B2 4/2011 Walker et al.
7,942,737 B2 5/2011 Cregan et al.
7,963,845 B2 6/2011 Baerlocher
7,993,191 B2 8/2011 Evans et al.
2001/0003710 A1 6/2001 Abramopoulos et al.
2001/0055989 A1 12/2001 Thomas
2002/0019253 A1 2/2002 Reitzen et al.

(56) References Cited

U.S. PATENT DOCUMENTS

| | | | | |
|---|---|---|---|---|
| 2002/0037762 | A1 | 3/2002 | Wood et al. | |
| 2002/0103021 | A1 | 8/2002 | Wood et al. | |
| 2002/0125641 | A1 | 9/2002 | Moody | |
| 2003/0092476 | A1* | 5/2003 | Fox | 463/13 |
| 2003/0130024 | A1 | 7/2003 | Darby | |
| 2004/0023713 | A1 | 2/2004 | Wolf et al. | |
| 2005/0059451 | A1* | 3/2005 | Shackleford | 463/13 |
| 2005/0059467 | A1* | 3/2005 | Saffari et al. | 463/19 |
| 2005/0202863 | A1 | 9/2005 | Macaulay | |
| 2006/0030403 | A1 | 2/2006 | Lafky | |
| 2006/0063578 | A1* | 3/2006 | Bansemer et al. | 463/13 |
| 2006/0135238 | A1 | 6/2006 | Lancaster et al. | |
| 2006/0183535 | A1 | 8/2006 | Marks et al. | |
| 2006/0211471 | A1 | 9/2006 | Walker et al. | |
| 2007/0054721 | A1 | 3/2007 | Jackson | |
| 2007/0060321 | A1 | 3/2007 | Vasquez et al. | |
| 2007/0135193 | A1 | 6/2007 | Nicely | |
| 2007/0135194 | A1 | 6/2007 | Nicely et al. | |
| 2007/0184887 | A1 | 8/2007 | Cannon | |
| 2007/0191088 | A1 | 8/2007 | Breckner et al. | |
| 2008/0020815 | A1 | 1/2008 | Lancaster et al. | |
| 2008/0020846 | A1 | 1/2008 | Vasquez et al. | |
| 2008/0039191 | A1 | 2/2008 | Cuddy | |
| 2008/0064462 | A1 | 3/2008 | Gerrard et al. | |
| 2008/0070674 | A1 | 3/2008 | Lancaster et al. | |
| 2008/0076500 | A1* | 3/2008 | Lancaster et al. | 463/12 |
| 2008/0090651 | A1 | 4/2008 | Baerlocher | |
| 2008/0108430 | A1 | 5/2008 | Evans | |
| 2008/0108431 | A1 | 5/2008 | Cuddy et al. | |
| 2008/0111309 | A1 | 5/2008 | Nicely et al. | |
| 2008/0113704 | A1 | 5/2008 | Jackson | |
| 2008/0113779 | A1 | 5/2008 | Cregan | |
| 2008/0119257 | A1 | 5/2008 | Stern et al. | |
| 2008/0188278 | A1 | 8/2008 | Paulsen et al. | |
| 2008/0207298 | A1 | 8/2008 | Marks et al. | |
| 2008/0214244 | A1 | 9/2008 | Toraguchi et al. | |
| 2008/0254847 | A1 | 10/2008 | Millerschone | |
| 2009/0005144 | A1 | 1/2009 | Moody | |
| 2009/0042645 | A1 | 2/2009 | Graham et al. | |
| 2009/0088244 | A1 | 4/2009 | Nicely et al. | |
| 2009/0104962 | A1 | 4/2009 | Nicely et al. | |
| 2009/0111561 | A1 | 4/2009 | Dewaal et al. | |
| 2009/0117959 | A1 | 5/2009 | Nicely | |
| 2009/0121434 | A1 | 5/2009 | Baerlocher et al. | |
| 2009/0124313 | A1 | 5/2009 | Nicely | |
| 2009/0124316 | A1 | 5/2009 | Baerlocher et al. | |
| 2009/0124334 | A1 | 5/2009 | Jones et al. | |
| 2009/0124362 | A1 | 5/2009 | Cuddy et al. | |
| 2009/0124363 | A1 | 5/2009 | Baerlocher et al. | |
| 2009/0124364 | A1 | 5/2009 | Cuddy et al. | |
| 2009/0181743 | A1 | 7/2009 | Bansemer et al. | |
| 2010/0004051 | A1 | 1/2010 | Walker et al. | |
| 2010/0035676 | A1 | 2/2010 | Nicely et al. | |
| 2010/0099480 | A1 | 4/2010 | Caputo | |
| 2010/0120484 | A1 | 5/2010 | Caputo et al. | |
| 2010/0120498 | A1 | 5/2010 | Cuddy et al. | |
| 2010/0120514 | A1 | 5/2010 | Caputo | |
| 2010/0144415 | A1* | 6/2010 | Wolf et al. | 463/13 |
| 2010/0190546 | A1 | 7/2010 | Baerlocher et al. | |
| 2010/0227661 | A1 | 9/2010 | Walker et al. | |
| 2010/0227677 | A1 | 9/2010 | Baerlocher | |
| 2010/0252997 | A1 | 10/2010 | Walker et al. | |
| 2010/0261524 | A1 | 10/2010 | Pawloski et al. | |
| 2010/0289220 | A1 | 11/2010 | Jackson | |
| 2010/0331068 | A1 | 12/2010 | Walker et al. | |
| 2011/0003625 | A1 | 1/2011 | Montross et al. | |
| 2011/0003637 | A1 | 1/2011 | LeFever | |
| 2011/0053676 | A1 | 3/2011 | Wolf et al. | |
| 2011/0111818 | A1 | 5/2011 | Baerlocher | |
| 2011/0111843 | A1 | 5/2011 | Nicely et al. | |
| 2011/0118011 | A1 | 5/2011 | Filipour et al. | |
| 2011/0183750 | A1 | 7/2011 | Cregan et al. | |
| 2011/0212768 | A1 | 9/2011 | Baerlocher | |

* cited by examiner

| HAND RANK | 1 coin pays | 2 coins pays | 3 coins pays | 4 coins pays | 5 coins pays |
|---|---|---|---|---|---|
| Royal Straight Flush | 250 | 500 | 750 | 1000 | 10000 |
| Straight Flush | 50 | 100 | 150 | 200 | 1000 |
| Four of a Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 1 | 2 | 3 | 4 | 5 |
| Jacks or Better | 1 | 2 | 3 | 4 | 5 |

302

| HAND RANK | 1 coin pays | 2 coins pays | 3 coins pays | 4 coins pays | 5 coins pays |
|---|---|---|---|---|---|
| Royal Straight Flush | 250 | 500 | 750 | 1000 | 750 |
| Straight Flush | 50 | 100 | 150 | 200 | 1000 |
| Four of a Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 1 | 2 | 3 | 4 | 5 |
| Jacks or Better | 1 | 2 | 3 | 4 | 5 |

302

| HAND RANK | 1 coin pays | 2 coins pays | 3 coins pays | 4 coins pays | 5 coins pays |
|---|---|---|---|---|---|
| Royal Straight Flush | 250 | 500 | 750 | 1000 | 750 |
| Straight Flush | 50 | 100 | 150 | 200 | 1000 |
| Four of a Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 1 | 2 | 3 | 4 | 5 |
| Jacks or Better | 1 | 2 | 3 | 4 | 5 |

302

GAMING SYSTEM AND METHOD FOR PROVIDING OPTIMAL POKER AUTO-HOLD FUNCTIONALITY WITH PROGRESSIVE AWARDS

COPYRIGHT NOTICE

A portion of the disclosure of this patent document contains or may contain material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

In recent years, video poker games have become very popular. One of the most common variations of video poker is Five Card Draw, which can be played on a gaming device using electronic cards. In general, for a play of a Five Card Draw poker game, the gaming device deals a player an initial hand of five cards face up from a fifty-two card deck of playing cards. The gaming device enables the player to discard none of, one of, a plurality of but less than all of, or all of the five cards from the initial hand. The gaming device replaces each discarded card with another card from the deck. After replacement of any discarded cards, the gaming device evaluates the cards of the player's hand against a paytable to determine whether the player's hand forms a winning hand associated with one of a plurality of different winning hand categories.

The paytable employed by the gaming device is determined based on the type of Five Card Draw poker game being played. Table 1 below includes the different winning hand categories, example winning hands associated with the different winning hand categories, and awards associated with the different winning hand categories for different wager amounts for an example Jacks or Better Five Card Draw poker game. These winning hand categories are listed from highest to lowest ranking. In this example, the winning hands of the "Jacks or Better" winning hand category, the lowest ranking winning hand category, include a pair of Jacks, a pair of Queens, a pair of Kings, and a pair of Aces. This example also includes progressive awards for the highest ranking winning hand categories, i.e., a royal flush and a straight flush, which could be earned if a player has wagered five credits.

TABLE 1

Winning Hand Categories, Example Winning Hands, and Awards for Example Jacks or Better Five Card Draw Poker Game

| Winning Hand Category | Example Winning Hand | Award (Wager of 1 Credit) | Award (Wager of 2 Credits) | Award (Wager of 3 Credits) | Award (Wager of 4 Credits) | Award (Wager of 5 Credits) |
|---|---|---|---|---|---|---|
| Royal Flush | A♣ K♣ Q♣ J♣ 10♣ | 250 | 500 | 750 | 1000 | Royal Rush Progressive |
| Straight Flush | 10♣ 9♣ 8♣ 7♣ 6♣ | 50 | 100 | 150 | 200 | Straight Flush Progressive |
| Four of a Kind | J♣ J♥ J♦ J♠ 3♣ | 25 | 50 | 75 | 100 | 125 |
| Full House | A♥ A♦ A♣ 6♦ 6♣ | 9 | 18 | 27 | 36 | 45 |
| Flush | A♣ J♣ 8♣ 6♣ 2♣ | 6 | 12 | 18 | 24 | 30 |
| Straight | 8♦ 7♣ 6♠ 5♠ 4♣ | 4 | 8 | 12 | 16 | 20 |
| Three of a Kind | Q♠ Q♥ Q♦ 6♦ 2♠ | 3 | 6 | 9 | 12 | 15 |
| Two Pair | 8♦ 8♥ 5♥ 5♣ 2♠ | 2 | 4 | 6 | 8 | 10 |
| Jacks or Better | K♦ K♠ 8♠ 7♠ 2♥ | 1 | 2 | 3 | 4 | 5 |

Within each category, hands are ranked according to the rank of individual cards, with an Ace being the highest card and a two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of straight flush, four of a kind, or flush, and there are over a hundred equivalent hands for each two pair variation. As a particular example, a straight flush including 5♠ 6♠ 7♠ 8♠ 9♠ is equivalent to a straight flush of all the same ranks but of a different suit such as 5♥ 6♥ 7♥ 8♥ 9♥.

Certain known video poker gaming devices have an auto-hold feature which displays recommendations to the player regarding which cards to hold and which cards to discard for optimal play. The gaming device executing an auto-hold program compares in an iterative manner the cards in the initial hand to a plurality of card patterns. Each card pattern is associated with a predetermined hold pattern, typically determined by the heuristics or experience of successful poker players, such as hold all five cards in the initial hand when they are a straight, hold the three cards when they are three kings, or discard all cards, for example. When the initial dealt hand matches a card pattern in the auto-hold program, the gaming device indicates to the player which cards to hold in accordance with the heuristics in the auto-hold program. The player can subsequently choose to select more cards than have been recommended to be held or de-select none, one, or more cards that have been recommended to be held.

The typical auto-hold feature in known gaming devices recommends the cards to hold based on the cards in the initial hand and/or the current paytable that denotes the awards for each possible winning hand that could result from the initial hand. An expected value for each possible way to hold the initial hand is looked up or calculated when determining which cards to recommend for holding. The expected value is calculated by determining the number of ways that each possible winning hand can occur, multiplying the number of ways by the award for that possible winning hand, then summing the product for each possible winning hand and dividing by the total number of possible outcomes. As such, the auto-hold feature recommends holding the cards that will yield the highest expected value, i.e., highest award. An auto-hold feature is described in commonly-owned U.S. Pat. No. 7,198,569.

Progressive awards are also known. Various video poker gaming devices include progressive awards for one, or a plurality (such as two), of the potential winning hands. Typically, one or more of the most valuable winning hands are associated with one or more progressive awards. In one form, a progressive award includes an initial amount funded by a casino and an additional amount funded through a portion of each wager made on one or more gaming devices associated with the progressive awards. For example, 1% of each wager placed on the primary game of the gaming device may be allocated to the progressive award or progressive award fund. The progressive award grows in value as more players play the gaming device(s) and more portions of the players' wagers are allocated to the progressive award. When a player obtains a winning hand which results in the progressive award, the accumulated progressive award is provided to the player. After the progressive award is provided to the player, the amount of the next progressive award is reset to the initial amount and a portion of each subsequent wager is allocated to that next progressive award.

If a winning hand matches more than one of the winning hand categories, the gaming device typically provides the highest progressive award. For example, a video poker gaming device includes a royal flush progressive award and a straight flush progressive award. The initial amount of the royal flush progressive award is typically greater than the initial amount of the straight flush progressive award, e.g., $10,000 and $2,000, respectively. As long as neither progressive award is provided to a player with a winning hand matching a royal flush or a straight flush, the royal flush progressive award will continue to be greater than the straight flush progressive award as each progressive award increases. If a winning hand matches both a royal flush and a straight flush, e.g., the winning hand includes A♣ K♣ Q♣ J♣ 10♣, the gaming device would provide the royal flush progressive award because that award is greater than the straight flush progressive award. However, the straight flush progressive award could be greater than the royal flush progressive award in certain situations. For example, if a player has been provided the royal flush progressive award, then the royal flush progressive award resets to its initial amount. At this point, the straight flush progressive award may have increased such that it is greater than the initial amount of the royal flush progressive award. Therefore, for this example winning hand, the gaming device provides the straight flush progressive award, even though a straight flush is a lower ranked winning hand category than a royal flush.

When determining recommendations of cards to hold in the initial hand dealt to a player, the auto-hold feature of known video poker gaming devices only takes into account the current amounts of multiple progressive awards when the higher ranking winning hand category has a higher progressive award. Such gaming devices recommend cards of an initial hand to hold based on the rankings of the winning hand categories. Accordingly, these gaming devices recommend the non-optimal cards to hold from an initial hand even if the progressive award of a lower ranked winning hand category is greater than the progressive award of a higher ranked winning hand category. Using the example above, in the event the straight flush progressive award is greater than the royal flush progressive award, the gaming device could recommend non-optimal cards to hold from the initial hand that could potentially lead to a winning hand including a royal flush. To be optimal, in this example, the gaming device should recommend cards to hold from the initial hand that could potentially lead to a winning hand including a straight flush since that winning hand would provide a greater award. Generally, it is more difficult to obtain a winning hand matching a higher ranked winning hand category than a winning hand matching a lower ranked winning hand category. In particular, for this example, it is more difficult to obtain a winning hand including a royal flush (i.e., a winning hand must include a ten, jack, queen, king, and ace of the same suit) than it is to obtain a winning hand that includes a straight flush (i.e., a winning hand includes a sequence of any five cards of the same suit).

A need therefore exists for gaming systems and gaming methods which provide draw poker games where the auto-hold functionality is enhanced to take multiple progressive awards into account.

SUMMARY

Various embodiments of the present disclosure are directed to a gaming system and method of operating a gaming system providing a draw poker game with auto-hold functionality that takes multiple progressive awards into account and recommends the optimal cards to hold from an initial hand. After dealing an initial hand of a draw poker game, the gaming system determines the optimal cards to be held from the initial hand based on the cards in the initial hand and the current amounts of the progressive awards. The optimal cards to be held are the cards that could potentially lead to a winning hand that provides the greatest progressive award, regardless of the rank of the winning hand category. In various embodiments, the gaming system examines each possible way the cards in the initial hand can be held and determines the expected value for each of the possible ways. Accordingly, in the case when a progressive award for a lower ranked winning hand category is greater than a progressive award for a higher ranked winning hand category, the gaming system determines the optimal cards to hold from an initial hand that could potentially lead to a winning hand associated with the lower ranked winning hand category. In this way, the gaming system assists the player in making decisions about which cards to hold from the initial hand that could lead to a winning hand that is easier to obtain and that provides a greater award.

More specifically, in an example embodiment, the gaming system displays a plurality of plays of a draw poker game. The draw poker game includes a plurality of different winning outcomes and a plurality of different awards associated with said different winning outcomes. The plurality of different winning outcomes includes a pair of jacks or better, two pair, three of a kind, a straight, a flush, a full house, four of a kind, a straight flush, and a royal flush. Each of these poker hands of these winning outcomes are respectively higher ranked poker hands. The plurality of different awards includes a first progressive award associated with a first one of the outcomes, and a second progressive award associated with a second one of the outcomes. The first of the outcomes is associated with a first poker hand and the second of the outcomes is associated with a second poker hand. The first poker hand is higher ranking than the second poker hand. In certain embodiments, the first of the outcomes is a royal flush and the second of the outcomes is a straight flush. In certain embodiments, each of the plurality of different awards includes a respective progressive award associated with each of the different winning outcomes.

For each play of the draw poker game, the gaming system displays a plurality of cards from a deck of cards as an initial hand for the play of the draw poker game. If the first progressive award is greater than the second progressive award for said play of the draw poker game, the gaming system displays a first auto-hold recommendation. If the second progressive award is greater than the first progressive award for the play of the draw poker game, the gaming system displays display a second different auto-hold recommendation. In certain embodiments, a designated initial hand and a designated plurality of cards of the designated initial hand is predetermined and is included in an auto-hold file. In certain embodiments, the auto-hold file includes an auto-hold table, and a compression table and compression index for reducing redundant entries in the auto-hold table. In certain embodiments, the gaming system calculates an expected value for each of the possible ways the cards of the initial hand can be held, and the first auto-hold recommendation and the second auto-hold recommendation are based on the expected value for each of the possible ways the cards of the initial hand can be held. In certain embodiments, the gaming system calculates the expected value based on the possible ways the cards of the initial hand can be held, the award for each of the winning outcomes, and a total number of possible outcomes of the initial hand.

The first auto-hold recommendation and the second auto-hold recommendation each includes a card hold recommendation that is related to zero, one, or a plurality of the cards of the initial hand and is displayed by the gaming system. After displaying the initial hand and the respective auto-hold recommendation, the gaming system receives at least one input from an input device which indicates that the player is holding zero, one, or a plurality of the cards of the initial hand. For each of the cards not held by the player, the gaming system replaces the card with one of the cards from the deck of cards to form a final hand. The gaming system then evaluates the final hand for any of the winning outcomes and provides any awards to the player.

Additional features and advantages are described herein, and will be apparent from, the following Detailed Description and the figures.

DETAILED DESCRIPTION

Various embodiments of the present disclosure are directed to a gaming system and method providing a draw poker game with auto-hold functionality that takes multiple progressive awards into account and recommends the optimal cards to hold from an initial hand. While the draw poker game with enhanced auto-hold functionality is described and employed in association with a primary game in the embodiments described below, it should be appreciated that the enhanced auto-hold functionality may additionally or alternatively be employed in associated with a secondary game or a bonus game. Moreover, while the credit balances, the wagers, and the awards are displayed as an amount of monetary credits or currency in the embodiments described below, one or more of such credit balances, such wagers, and such awards may be for non-monetary credits, promotional credits, and/or player tracking points or credits.

Figure 1:
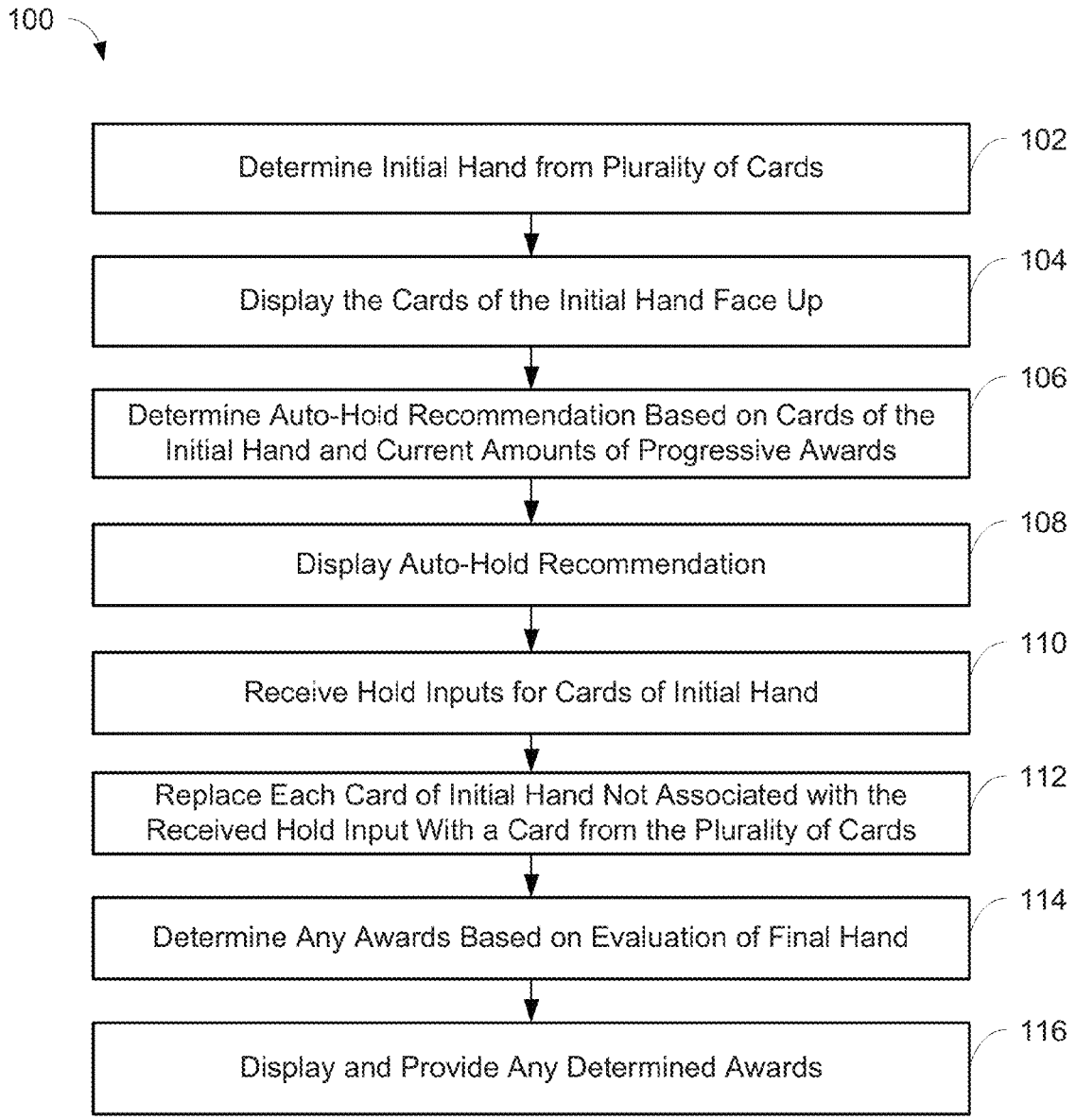
FIG. 1 is a flowchart illustrating a method of operating an example embodiment of the gaming system of the present disclosure configured to operate a video poker card game.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system is configured to operate a draw poker game associated with a plurality of cards. For a play of the draw poker game for a player, the gaming system determines an initial hand from the plurality of cards, as indicated by block 102. In some embodiments, the initial hand includes five cards for a Five Card Draw poker game. The draw poker game includes different winning outcomes, such as a pair of jacks or better, two pair, three of a kind, straight, flush, full house, four of a kind, straight flush, and royal flush. Each winning outcome is associated with different awards, such as progressive awards and/or non-progressive awards. In some embodiments, some or all of the winning outcomes are associated with progressive awards. In some embodiments, a straight flush winning outcome and a royal flush winning outcome are respectively associated with separate progressive awards.

The gaming system displays face-up the cards of the initial hand, as indicated by block 104. The gaming system determines an auto-hold recommendation based on the cards of the initial hand and the current amounts of progressive awards, as indicated by block 106. The auto-hold recommendation is based on an expected value for each of the possible ways the cards of the initial hand can be held. The expected value is based on the possible ways the cards of the initial hand can be held, the award for each of the winning outcomes (from the current paytable for the draw poker game), and a total number of possible outcomes of the initial hand. The auto-hold recommendation determined by the gaming system is the optimal set of cards to hold from the initial hand based on the current amounts of the multiple progressive awards associated with some or all of the different winning outcomes. The optimal set of cards to hold from the initial hand are the cards that could potentially lead to a winning hand that provides the greatest progressive award, regardless of the rank of the winning hand. Further details of determining the auto-hold recommendation are described below with respect to the process 106 shown in FIG. 2.

The gaming system displays the auto-hold recommendation, as indicated by block 108. The gaming system enables the player to hold none, one, or more of the cards of the initial hand and, accordingly, receives none, one, or more hold inputs associated with the cards of the initial hand, as indicated by block 110. The gaming system replaces each card of the initial hand not associated with the received hold inputs with a card from the plurality of cards, as indicated by block 112, to form a final hand. In other words, for each card of the initial hand associated with the received hold inputs, the gaming system keeps that card in the initial hand. For each card of the initial hand not associated with the received hold inputs, the gaming system removes that card from the initial hand, determines a drawn card from the plurality of cards, and replaces the removed card with the drawn card. The gaming system determines any awards based on an evaluation of the final hand with the different winning outcomes, as indicated by block 114, and displays and provides any determined awards, as indicated by block 116.

Figure 2A:
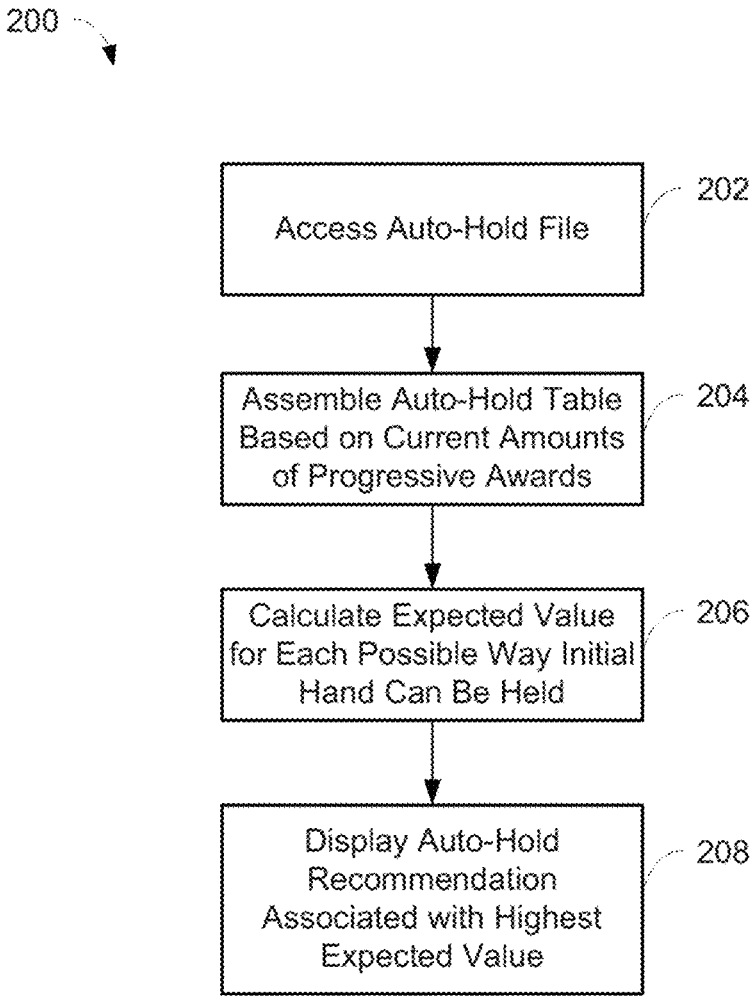
FIG. 2A is a flowchart illustrating a method of operating an example embodiment of the gaming system of the present disclosure configured to determine an auto-hold recommendation for a video poker card game.

FIG. 2A illustrates a flowchart of an example process or method 200 of operating the gaming system of the present disclosure to determine an auto-hold recommendation for a video poker card game. The process 200 corresponds to an embodiment of the block 106 described above in the process 100 shown in FIG. 1. In determining the auto-hold recommendation for an initial hand of a draw poker game, the gaming system accesses an auto-hold file, as indicated by block 202. The auto-hold file includes data used to calculate the number of hands that match each wining outcome. The number of hands that match each winning outcome are used in calculating an expected value, as described below. The auto-hold recommendation includes cards to hold from the initial hand that yield the highest expected value.

The auto-hold file includes an auto-hold table, and a compression table and compression index for reducing redundant entries in the auto-hold table. Auto-hold tables, compression tables, and compression indices are described in commonly-owned U.S. Pat. No. 7,198,569. The auto-hold file is used in determining the auto-hold recommendation. Because many rows in the auto-hold table are identical, only unique rows are stored and referenced by the compression table, so that the size of the auto-hold table is significantly reduced. For example, the auto-hold table in conjunction with the compression table reduces the size of the auto-hold table from approximately 294,000 rows to less than 150 rows. The type of auto-hold algorithm used by the gaming system to determine an auto-hold recommendation varies in different embodiments. In one embodiment, the gaming system determines the expected value for each possible way to hold the initial hand by calculating the expected value upon every play of the game, without use of an auto-hold table. In this case, the gaming system reorders the entries in the paytable by the amounts of the progressive and non-progressive awards, regardless of hand rank, when calculating the expected values. In another embodiment, the gaming system determines the expected values by using tables of winning outcome counts that are included in the auto-hold file. In this case, the auto-hold file includes such tables for each possible order of progressive awards, or partial tables that include only the differences from a default table, i.e., the table that includes the awards ranked in the same order as the hand ranks. In an embodiment, portions of a table in the auto-hold file include references to other tables in the auto-hold file so that each table in the auto-hold file can be dynamically constituted, as necessary. In this way, only unique portions of tables that are associated with each possible order of progressive awards need to be stored in the auto-hold file, resulting in a reduced size of the auto-hold file.

The gaming system assembles an auto-hold table based on the current amounts of the progressive awards, as indicated by block 204. The assembled auto-hold table is dynamically constructed from pre-calculated portions of auto-hold tables in the auto-hold file previously accessed. As described above, tables for each possible order of progressive awards are included in the auto-hold file, and accordingly, those tables are utilized when assembling the auto-hold table appropriate for the current amounts of the progressive awards. The gaming system calculates an expected value based on the assembled auto-hold table for each possible way the cards of the initial hand can be held, as indicated by block 206. Because the assembled auto-hold table took into account the current amounts of the progressive awards, the expected values calculated also take into account the current amounts of the progressive awards. The number of hands that match a particular winning outcome is dependent on the paytable for the video poker card game. The gaming system calculates the expected value for each possible way to hold the initial hand by multiplying the number of ways by the award for that possible winning hand, summing the product for each possible winning hand, and dividing by the total number of possible outcomes. Exemplary calculations of the expected value for each possible way to hold the initial hand are described in commonly-owned U.S. Pat. No. 7,198,569. The gaming system displays the auto-hold recommendation associated with the highest calculated expected value, as indicated by block 208. The auto-hold recommendation that is displayed is associated with the cards of the initial hand that yield the highest expected value. The cards suggested to be held from the initial hand are the optimal set of cards to hold that could potentially lead to a winning hand that provides the greatest progressive award, regardless of the rank of the winning hand.

Figure 2B:
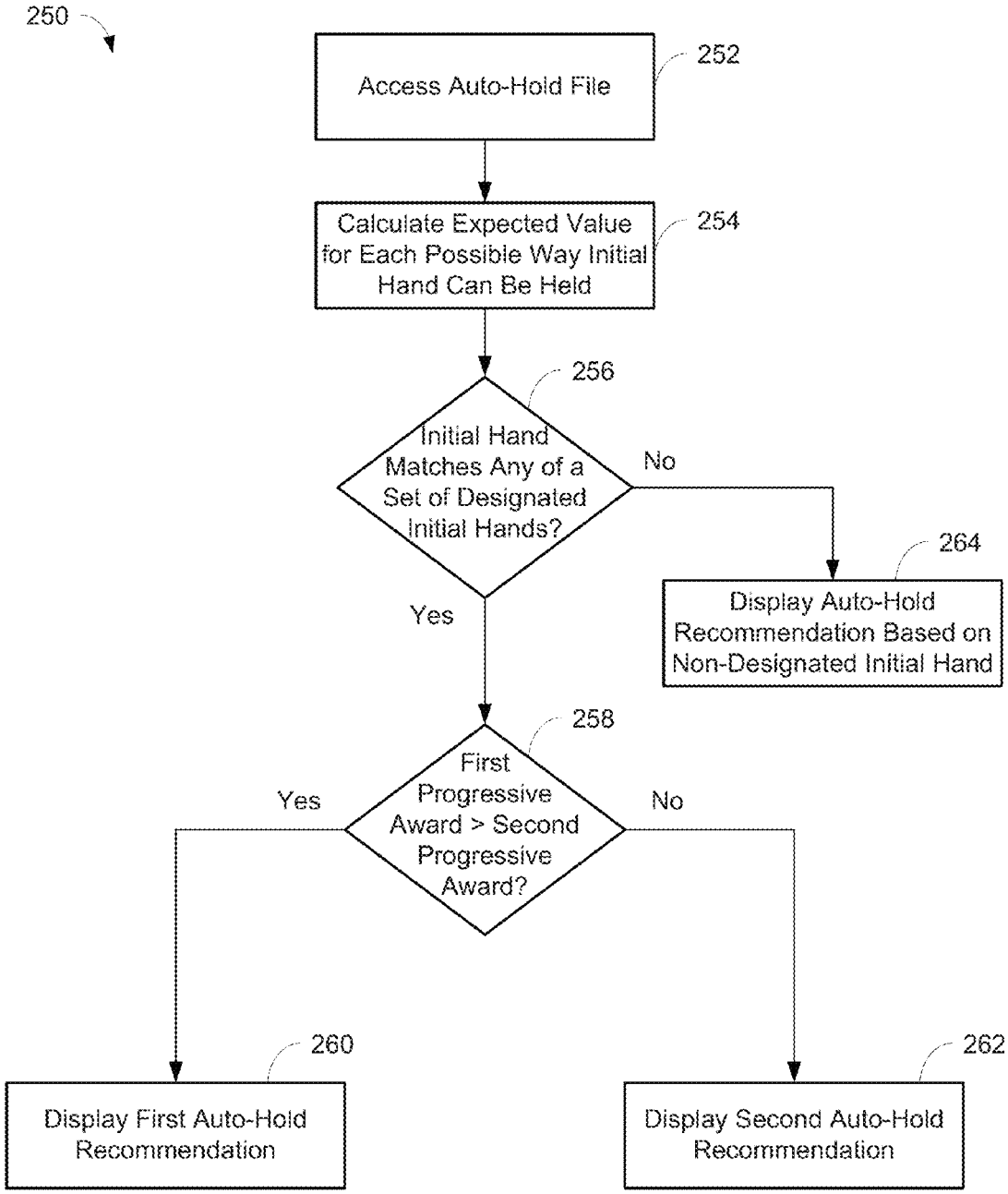
FIG. 2B is a flowchart illustrating a method of operating another example embodiment of the gaming system of the present disclosure configured to determine an auto-hold recommendation for a video poker card game.

FIG. 2B illustrates a flowchart of another example process or method 250 of operating the gaming system of the present disclosure to determine an auto-hold recommendation for a video poker card game. The process 250 corresponds to an alternative embodiment of the block 106 described above in the process 100 shown in FIG. 1. In determining the auto-hold recommendation for an initial hand of a draw poker game, the gaming system accesses an auto-hold file, as indicated by block 252. The auto-hold file includes one or more designated initial hands that can match the initial hand of the draw poker game. Each designated initial hand includes a designated plurality of cards that could potentially lead to a winning hand corresponding to a progressive award. In some embodiments, the auto-hold file includes an auto-hold recommendation for each designated initial hand, the number of hands that match each winning outcome, and/or data used to calculate the number of hands that match each wining outcome. The number of hands that match each winning outcome are used in calculating an expected value, as described below. The auto-hold recommendation includes cards to hold from the initial hand that yield the highest expected value.

The gaming system calculates an expected value for each possible way the cards of the initial hand can be held, as indicated by block 254. For example, if there are five cards in the initial hand, there are thirty-two ways the cards can be held. As described above, in some embodiments, the auto-hold file includes the number of hands that match each winning outcome. The number of hands that match a particular winning outcome is dependent on the paytable for the video poker card game. The gaming system calculates the expected value for each possible way to hold the initial hand by multiplying the number of ways by the award for that possible winning hand, summing the product for each possible winning hand, and dividing by the total number of possible outcomes. Exemplary calculations of the expected value for each possible way to hold the initial hand are described in commonly-owned U.S. Pat. No. 7,198,569.

The gaming system determines whether the cards of the initial hand match any of a set of designated initial hands, as indicated by diamond 256. The designated initial hands are those initial hands that could potentially lead to a winning hand corresponding to a progressive award. It is possible for a particular initial hand to match more than one of the designated initial hands. When the gaming system determines whether the cards of the initial hand match any of a set of designated initial hands, the gaming system also determines whether a particular designated initial hand corresponds to an auto-hold recommendation that could result in a winning hand that corresponds to a progressive award. In an embodiment, the gaming system dynamically builds and utilizes an auto-hold table that is appropriate and based on the current amounts of the progressive awards. If the cards of the initial hand do not match any of the set of designated initial hands, then the gaming system determines and displays an auto-hold recommendation based on a non-designated initial hand, as indicated by block 264. The non-designated initial hand is an initial hand that does not potentially lead to a winning hand corresponding to a progressive award, but instead potentially leads to another winning hand that corresponds to a non-progressive award. The auto-hold recommendation displayed is associated with the cards of the initial hand that yield the highest expected value.

However, if the initial hand matches any of the set of designated initial hands, then the gaming system determines whether a first progressive award is greater than a second progressive award, as indicated by diamond 258. The first progressive award is associated with a winning hand that has a higher ranking than a winning hand associated with the second progressive award. If the first progressive award is greater than the second progressive award, then the gaming system determines and displays a first auto-hold recommendation for the initial hand, as indicated by block 260, that could potentially lead to the winning hand associated with the first progressive award. However, if the first progressive award is not greater than the second progressive award, then the gaming system determines and displays a second auto-hold recommendation for the initial hand, as indicated by block 262, that could potentially lead to the winning hand associated with the second progressive award. In this way, the gaming system recommends the optimal set of cards to hold from the initial hand that could lead to a winning hand that provides the greatest progressive award, regardless of the rank of the winning hand.

Figure 3:
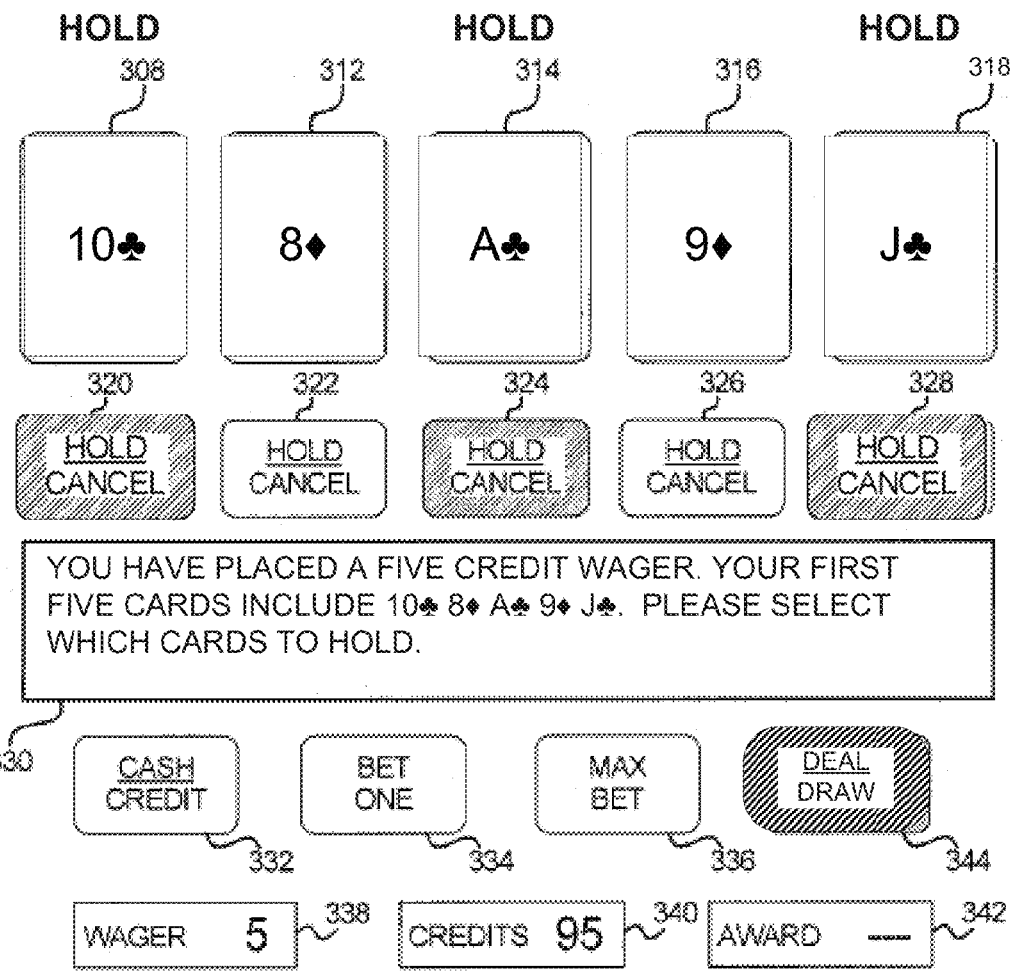
FIG. 3 illustrates a screen shot of the display device of the gaming system of the present disclosure operating an example video poker card game of the present disclosure.
Figure 4A:
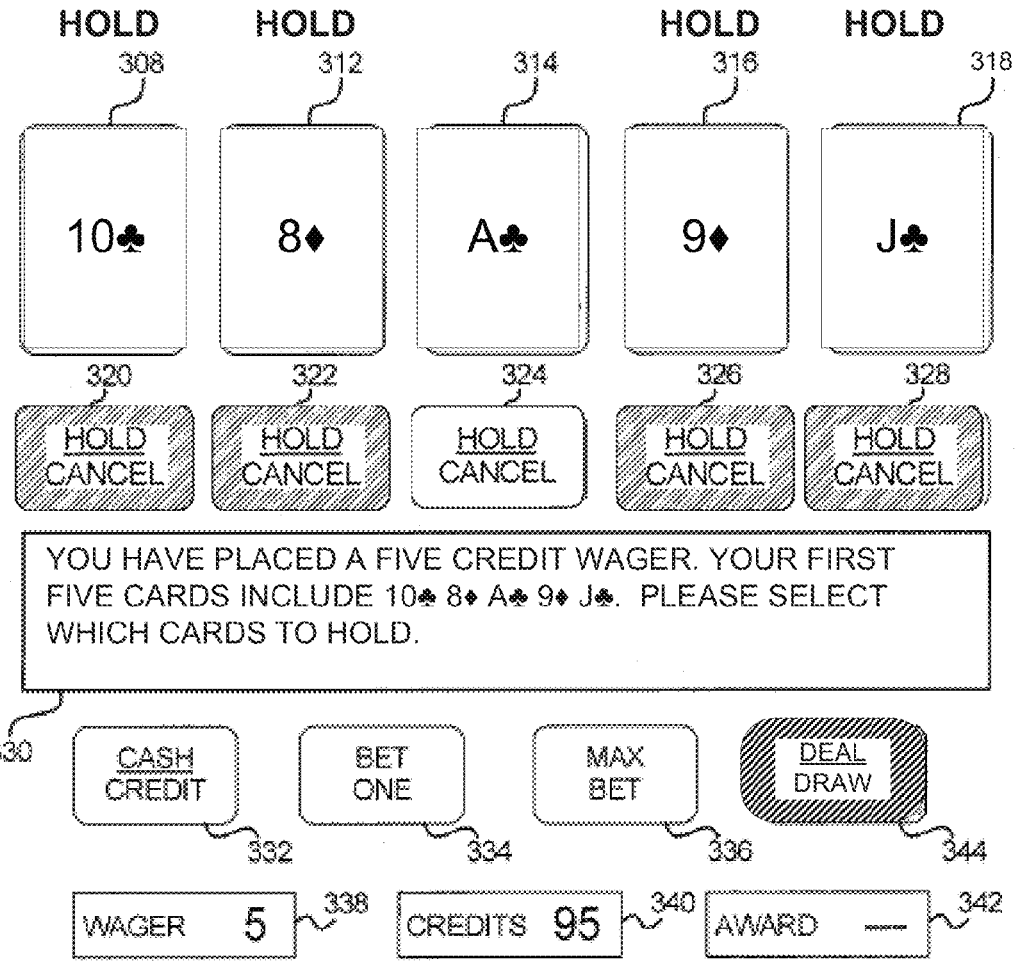
FIG. 4A illustrates a screen shot of the display device of the gaming system of the present disclosure operating another example video poker card game of the present disclosure.
Figure 4B:
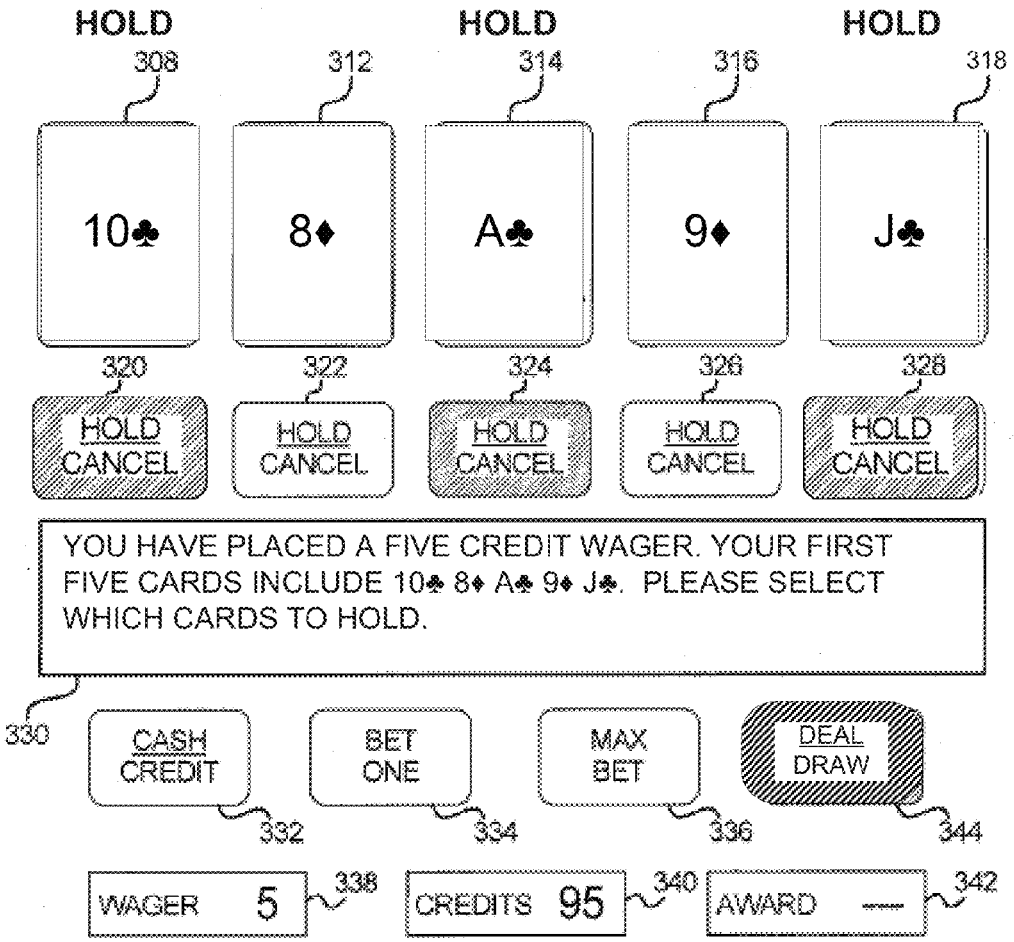
FIG. 4B illustrates a screen shot of the display device of the gaming system of the present disclosure operating another example video poker card game of the present disclosure.

FIGS. 3, 4A, and 4B illustrate screen shots of the display device of example embodiments of the gaming system of the present disclosure operating a draw poker game with auto-hold functionality that takes multiple progressive awards into account and recommends the optimal cards to hold from an initial hand. In this example, the draw poker game is associated with a plurality of cards including a standard fifty-two card deck of playing cards. It should be appreciated that the plurality of cards may include any suitable cards, such as multiple decks of cards or standard decks of cards including Jokers. The gaming system displays, such as on a display device 1116 or 1118 (as described below), a number of inputs, message areas, and other information. In one embodiment, the gaming system displays a paytable 302. In the examples shown in FIGS. 3, 4A, and 4B, the paytable 302 includes a number of winning hands including a royal flush, a straight flush, a four of a kind, a full house, a flush, a straight, a three of a kind, two pairs, and a pair of jacks or better. Each of the different winning hands has an associated award according to the number of credits wagered. In the example shown in FIG. 3, the award for a royal flush with five coins wagered is a progressive award with an initial amount of 10,000. The award for a straight flush with five coins wagered is a progressive award with an initial amount of 1,000. It should be appreciated that any suitable awards may be used with different winning hands, and that certain winning hands may not provide any awards.

The gaming system also displays five card positions 308, 312, 314, 316, and 318, hold inputs 320, 322, 324, 326, and 328, and message display 330. The gaming system further displays a cash/credit input 332, a bet one input 334, a max bet input 336, a deal/draw input 344, a wager display 338, a credits display 340, and an awards display 342. It should be appreciated that in other embodiments, any suitable number or arrangement of inputs and displays may be used to facilitate the play of the game. As shown in FIG. 3, in this example play of the draw poker game, a player has chosen to wager the maximum number of five coins, as indicated by the wager display 338. The gaming system indicates the wager in the message display 330 and reveals the values of the five cards of the initial hand. In this example play of the draw poker game, the card in the position 308 is the 10♣, the card in the position 312 is the 8♦, the card in the position 314 is the A♣, the card in the position 316 is the 9♦, and the card in the position 318 is the J♣.

For the example play shown in FIG. 3, the gaming system displays an auto-hold recommendation for this initial hand that suggests the optimal cards to hold that could potentially lead to a royal flush, which corresponds to the greatest award, i.e., 10,000, the current amount of the royal flush progressive award. In particular, the auto-hold recommendation suggests holding the 10♣, A♣, and J♣, as indicated by a card hold recommendation denoted by the activated hold inputs 320, 324, and 328 and the word "HOLD" displayed above each of the cards 308, 314, and 318. These particular cards are recommended to be held because the gaming system has calculated a higher expected value by holding these cards compared to holding other cards of the initial hand. In this example, the amounts of the awards are ranked in the same order as the winning hands. The deal/draw input 344 is activated to enable the player to discard the non-held cards and replace them with other cards from the deck of cards. The replaced cards need to include a Q♣ and K♣ to complete the royal flush. It is also possible that the replaced cards could lead to a non-winning hand, or other winning hands, such as a flush, straight, three of a kind, two pair, or jacks or better. The player is also enabled to select the other hold inputs 322 and 326 to hold those respective cards, and/or to de-select the activated hold inputs 320, 324, and 328 to not hold those respective cards, if desired. In some embodiments, if the player changes the cards held from the initial hand, the gaming system compares the cards of the auto-hold recommendation with the player's choice of cards to hold in rating a skill level of the player.

In the example shown in FIG. 4A, the award for a royal flush with five coins wagered is a progressive award with an initial amount of 750, and the award for a straight flush with five coins wagered is a progressive award with a current amount of 1000. The progressive award associated with the straight flush is higher than the progressive award associated with the royal flush because the progressive award associated with the royal flush has been provided to a player and been reset to its initial amount, for example. In this example, the amounts of the awards are not ranked in the same order as the winning hands, i.e., the straight flush progressive award is higher than the royal flush progressive award. In the example play of the draw poker game shown in FIG. 4A, the cards are the same as in the example shown in FIG. 3, i.e., 10♣, 8♦, A♣, 9♦, and J♣.

However, if the gaming system does not take the current amounts of the progressive awards into account, then in the example shown in FIG. 4A, the gaming system displays a non-optimal auto-hold recommendation for this initial hand. In particular, the auto-hold recommendation suggests holding the 10♣, 8♦, 9♦, and J♣, as indicated by a card hold recommendation denoted by the activated hold inputs 320, 322, 326, and 328 and the word "HOLD" displayed above each of the cards 308, 312, 316, and 318. These particular cards are recommended to be held because the gaming system has calculated a higher expected value by holding these cards compared to holding other cards of the initial hand. In this example, the gaming system does not recognize that a winning hand including a royal flush (a specific type of straight flush) would pay the currently higher straight flush progressive award. As such, the auto-hold recommendation is non-optimal. The deal/draw input 344 is activated to enable the player to discard the non-held cards and replace them with other cards from the deck of cards. In this example, if the auto-hold suggestion is not changed by the player, the replaced card needs to include a 7 of any suit or Q of any suit to complete a straight, or a J♦, J♥, or J♠ to have jacks or better. It is also possible that the replaced cards could lead to a non-winning hand. The player is also enabled to select the other hold input 324 to hold those respective cards, and/or to de-select the activated hold inputs 320, 322, 326, and 328 to not hold those respective cards, if desired.

In the example shown in FIG. 4B, the award for a royal flush with five coins wagered is a progressive award with an initial amount of 750, and the award for a straight flush with five coins wagered is a progressive award with a current amount of 1000, as in the example shown in FIG. 4A. The progressive award associated with the straight flush is higher than the progressive award associated with the royal flush because the progressive award associated with the royal flush has been provided to a player and been reset to its initial amount, for example. In this example, the amounts of the awards are not ranked in the same order as the winning hands. Therefore, even though a straight flush is a lower ranked hand than a royal flush, it is more desirable for a player to earn the progressive award for a straight flush, as a straight flush is a winning hand that is easier to obtain and that provides a greater award. In the example play of the draw poker game shown in FIG. 4B, the cards are the same as in the example shown in FIGS. 3 and 4A, i.e. 10♣, 8♦, A♣, 9♦, and J♣.

However, in the example shown in FIG. 4B, the gaming system properly takes the current amounts of the progressive awards into account, unlike in the example shown in FIG. 4A. Accordingly, the gaming system displays an optimal auto-hold recommendation for this initial hand that suggests the cards to hold that could potentially lead to a straight flush, which corresponds to the greatest award, i.e., 1000, the current amount of the straight flush progressive award. In particular, the auto-hold recommendation suggests holding the 10♣, A♣, and J♣, as indicated by a card hold recommendation denoted by the activated hold inputs 320, 324, and 328 and the word "HOLD" displayed above each of the cards 308, 314, and 318. These particular cards are recommended to be held because the gaming system has calculated a higher expected value by holding these cards compared to holding other cards of the initial hand. In other words, the gaming system recognizes that holding these cards from the initial hand could result in a royal flush (a specific type of straight flush) that would pay the currently higher straight flush progressive award. The deal/draw input 344 is activated to enable the player to discard the non-held cards and replace them with other cards from the deck of cards. If the auto-hold suggestion is not changed by the player, the replaced cards need to include the Q♣ and K♣ to complete the straight flush. It is also possible that the replaced cards could lead to a non-winning hand, or other winning hands, such as a flush, straight, three of a kind, two pair, or jacks or better. The player is also enabled to select the other hold inputs 322 and 326 to hold those respective cards, and/or to de-select the activated hold inputs 320, 324, and 328 to not hold those respective cards, if desired.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
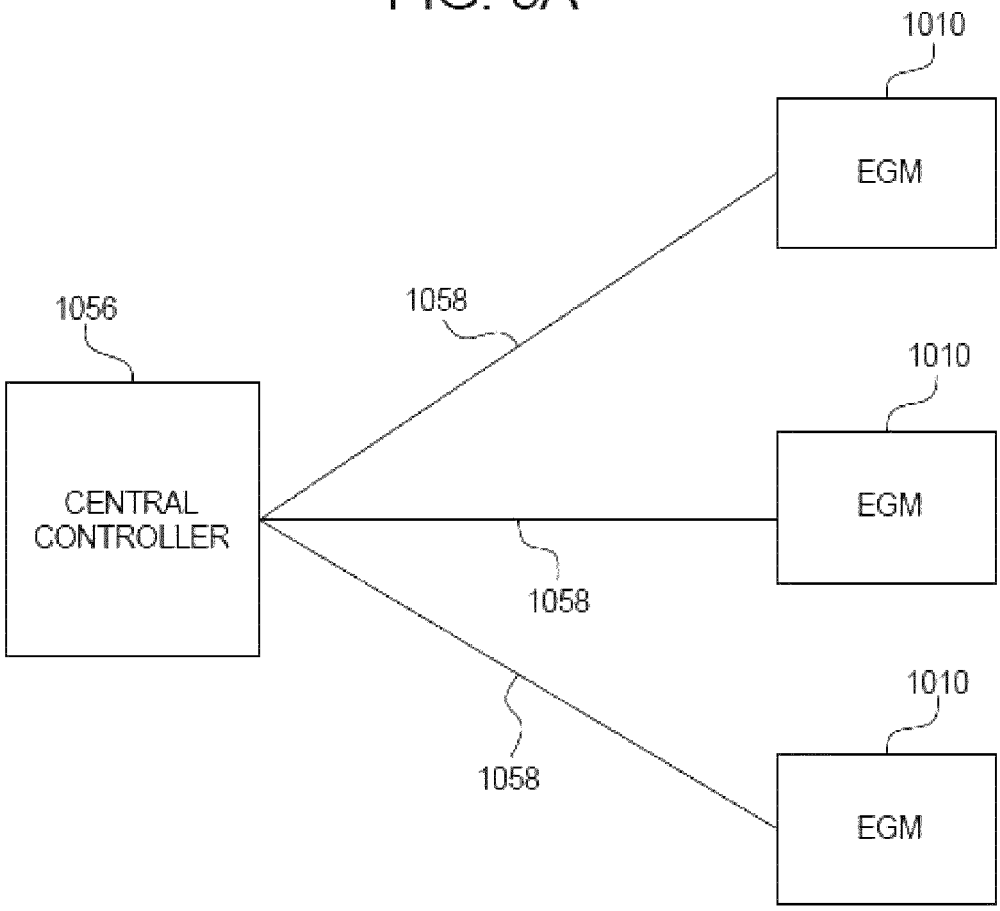
FIG. 5A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
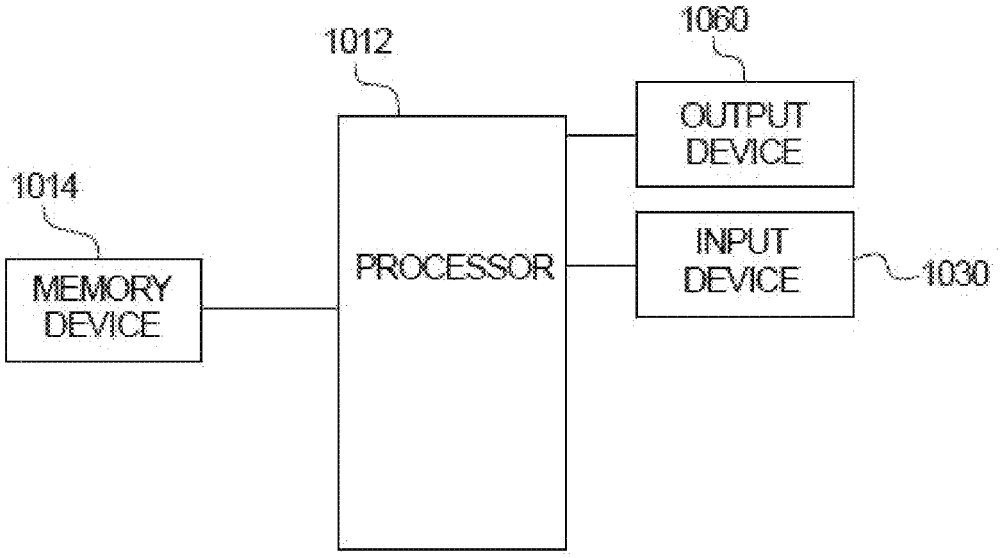
FIG. 5B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
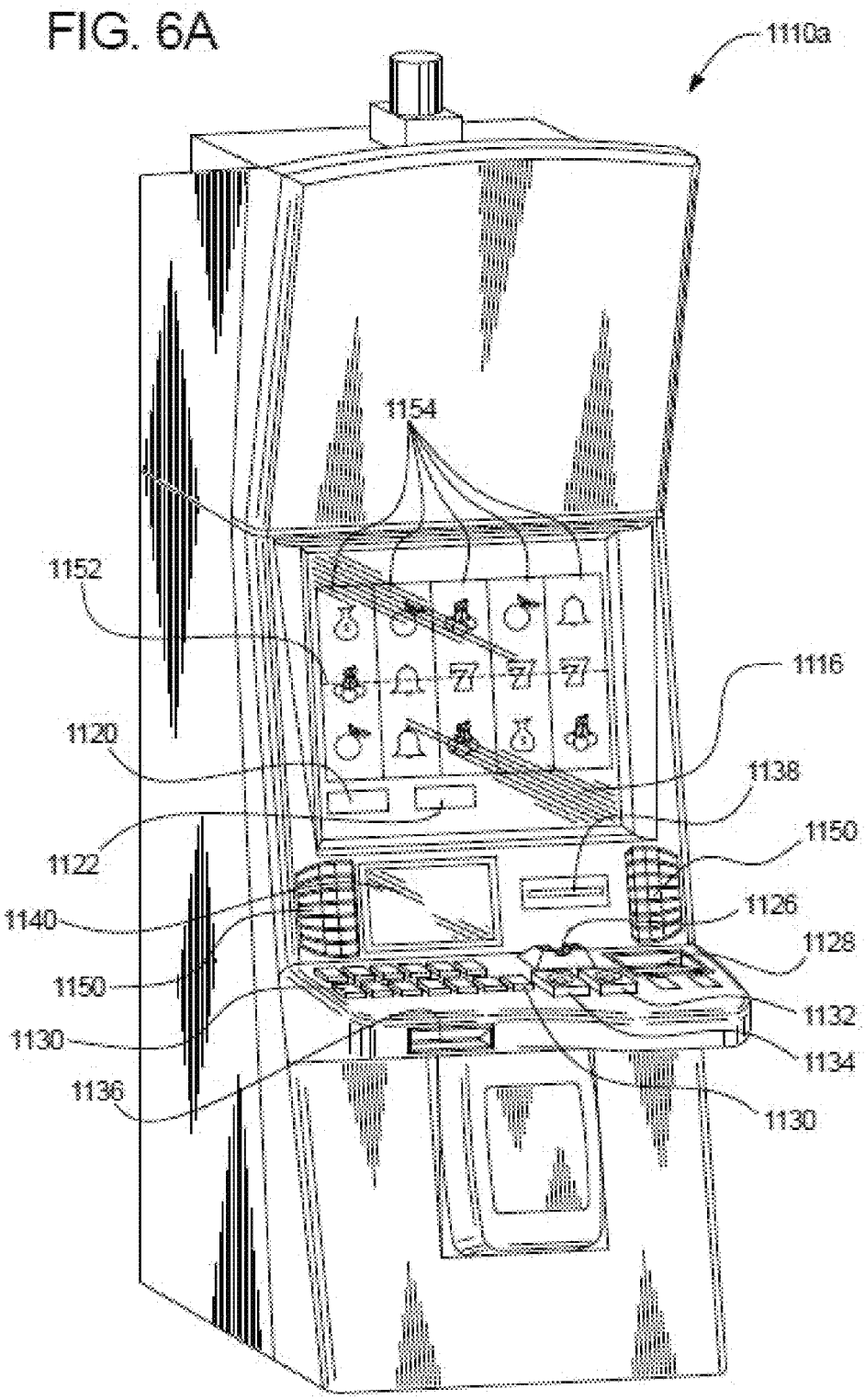
FIGS. 6A and 6B are perspective views of example alternative embodiments of the gaming system of the present disclosure.
Figure 6B:
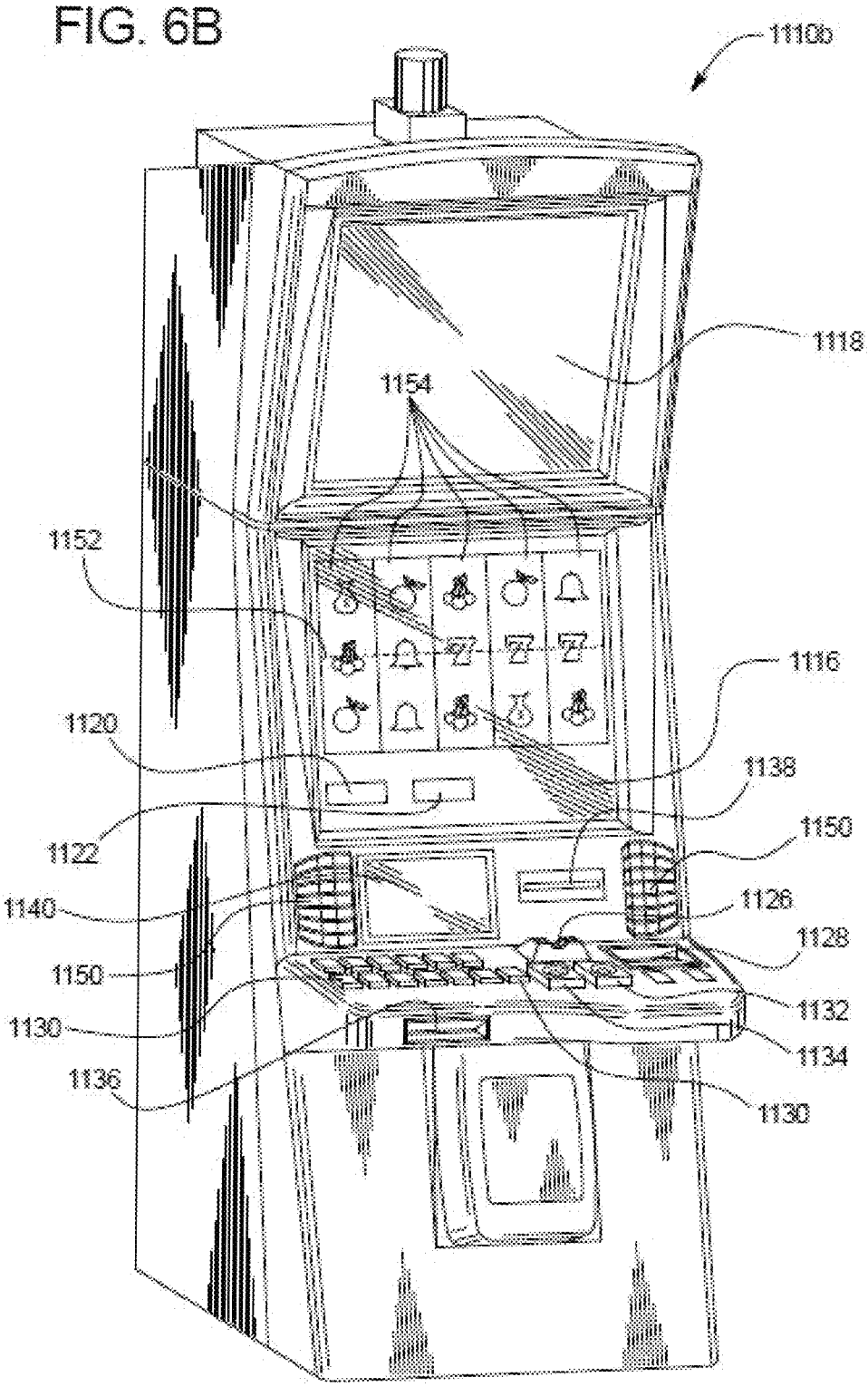

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 6B each includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device;

at least one input device; and at least one memory device storing a plurality of instructions which, when executed by the at least one processor, cause the at least one processor to operate with the at least one display device and the at least one input device to display a plurality of plays of a draw poker game, said draw poker game including a plurality of different winning outcomes, said draw poker game including a plurality of different awards associated with said different winning outcomes, said plurality of different awards including a first progressive award associated with a first one of the winning outcomes and a second progressive award associated with a second one of the winning outcomes, and for each play of the draw poker game:

(a) display a plurality of cards from a deck of cards as an initial hand for said play of the draw poker game;

(b) display a first auto-hold recommendation if a value of the first progressive award is greater than a value of the second progressive award for said play of the draw poker game;

(c) display a second different auto-hold recommendation if the value of the second progressive award is greater than the value of the first progressive award for said play of the draw poker game;

(d) receive at least one input from the at least one input device, said at least one input indicating that a player is holding zero, one, or a plurality of the cards of the initial hand;

(e) for each of the cards of the initial hand not indicated as held by the player, replace said card with one of the cards from the deck of cards to form a final hand; and (f) if the final hand includes any of the winning outcomes, provide the award associated with said winning outcome to the player.

2. The gaming system of claim 1, wherein the plurality of different winning outcomes include a pair of jacks or better, a two pair, a three of a kind, a straight, a flush, a full house, a four of a kind, a straight flush, and a royal flush.

3. The gaming system of claim 2, wherein the first one of the winning outcomes is the royal flush and the second one of the winning outcomes is the straight flush.

4. The gaming system of claim 1, wherein each of the plurality of different awards includes a respective progressive award associated with each of the different winning outcomes.

5. The gaming system of claim 1, wherein:

the plurality of instructions, when executed by the at least one processor, cause the at least one processor to calculate an expected value for each of a plurality of possible ways the cards of the initial hand can be held; and the first auto-hold recommendation and the second auto-hold recommendation are based on the expected value for each of the plurality of possible ways the cards of the initial hand can be held.

6. The gaming system of claim 5, wherein the plurality of instructions, when executed by the at least one processor, cause the at least one processor to calculate the expected value based on the plurality of possible ways the cards of the initial hand can be held, the plurality of different awards for each of the different winning outcomes, and a total number of possible outcomes of the initial hand.

7. The gaming system of claim 1, wherein the plurality of instructions, when executed by the at least one processor, cause the at least one processor to operate with the at least one display device to display a card hold recommendation related to zero, one, or the plurality of the cards of the initial hand to be held, wherein the card hold recommendation is associated with the first auto-hold recommendation or the second auto-hold recommendation.

8. The gaming system of claim 1, wherein:

the first one of the winning outcomes is a first poker hand;

the second one of the winning outcomes is a second poker hand; and the first poker hand is higher ranking than the second poker hand.

9. The gaming system of claim 1, wherein the plurality of instructions, when executed by the at least one processor, cause the at least one processor to access an auto-hold file stored in the at least one memory device, the auto-hold file including a designated initial hand, a designated plurality of cards of the designated initial hand, the first auto-hold recommendation, and the second auto-hold recommendation.

10. The gaming system of claim 1, wherein the plurality of instructions, when executed by the at least one processor, cause the at least one processor to access an auto-hold file stored in the at least one memory device, the auto-hold file including one or more of a compression table, a compression index, and an auto-hold table.

11. A method of operating a gaming system, said method comprising:

for a play of a draw poker game, said draw poker game including a plurality of different winning outcomes, said draw poker game including a plurality of different awards associated with said different winning outcomes, said plurality of different awards including a first progressive award associated with a first one of the winning outcomes and a second progressive award associated with a second one of the winning outcomes:

(a) causing at least one processor to execute a plurality of instructions stored in at least one memory device to operate with at least one display device to display a plurality of cards from a deck of cards as an initial hand for said play of the draw poker game;

(b) causing the at least one processor to execute the plurality of instructions to operate with the at least one display device to display a first auto-hold recommendation if a value of the first progressive award is greater than a value of the second progressive award for said play of the draw poker game;

(c) causing the at least one processor to execute the plurality of instructions to operate with the at least one display device to display a second different auto-hold recommendation if the value of the second progressive award is greater than the value of the first progressive award for said play of the draw poker game;

(d) receiving at least one input from at least one input device, said at least one input indicating that a player is holding zero, one, or a plurality of the cards of the initial hand;

(e) for each of the cards of the initial hand not indicated as held by the player, causing the at least one processor to execute the plurality of instructions to operate with the at least one display device to replace said card with one of the cards from the deck of cards to form a final hand; and (f) causing the at least one processor to execute the plurality of instructions to operate with the at least one display device to, if the final hand includes any of the winning outcomes, display the award associated with said winning outcome to the player.

12. The method of claim 11, wherein the plurality of different winning outcomes include a pair of jacks or better, a two pair, a three of a kind, a straight, a flush, a full house, a four of a kind, a straight flush, and a royal flush.

13. The method of claim 12, wherein the first one of the winning outcomes is the royal flush and the second one of the winning outcomes is the straight flush.

14. The method of claim 11, wherein each of the plurality of different awards includes a respective progressive award associated with each of the different winning outcomes.

15. The method of claim 11, which includes causing the at least one processor to execute the plurality of instructions to calculate an expected value for each of a plurality of possible ways the cards of the initial hand can be held, wherein the first auto-hold recommendation and the second auto-hold recommendation are based on the expected value for each of the plurality of possible ways the cards of the initial hand can be held.

16. The method of claim 15, which includes causing the at least one processor to execute the plurality of instructions to calculate the expected value based on the plurality of possible ways the cards of the initial hand can be held, the plurality of different awards for each of the different winning outcomes, and a total number of possible outcomes of the initial hand.

17. The method of claim 11, which includes causing the at least one processor to execute the plurality of instructions to operate with the at least one display device to display a card hold recommendation related to zero, one, or the plurality of the cards of the initial hand to be held, wherein the card hold recommendation is associated with the first auto-hold recommendation or the second auto-hold recommendation.

18. The method of claim 11, wherein:

the first one of the winning outcomes is a first poker hand;

the second one of the winning outcomes is a second poker hand; and the first poker hand is higher ranking than the second poker hand.

19. The method of claim 11, which includes causing the at least one processor to execute the plurality of instructions to access an auto-hold file stored in the at least one memory device, the auto-hold file including a designated initial hand, a designated plurality of cards of the designated initial hand, the first auto-hold recommendation, and the second auto-hold recommendation.

20. The method of claim 11, which includes causing the at least one processor to execute the plurality of instructions to access an auto-hold file stored in the at least one memory device, wherein the auto-hold file includes one or more of a compression table, a compression index, and an auto-hold table.

* * * * *